US008983327B2

(12) United States Patent
Yabuuchi et al.

(10) Patent No.: US 8,983,327 B2
(45) Date of Patent: Mar. 17, 2015

(54) FIXING CONTROL APPARATUS, FIXING CONTROL PROGRAM PRODUCT, AND IMAGE FORMING APPARATUS

(71) Applicants: Masayuki Yabuuchi, Kanagawa (JP); Ko Tokumaru, Tokyo (JP); Katsunori Kume, Kanagawa (JP)

(72) Inventors: Masayuki Yabuuchi, Kanagawa (JP); Ko Tokumaru, Tokyo (JP); Katsunori Kume, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/903,255

(22) Filed: May 28, 2013

(65) Prior Publication Data

US 2014/0016958 A1 Jan. 16, 2014

(30) Foreign Application Priority Data

Jul. 13, 2012 (JP) ..... 2012-157681
Feb. 28, 2013 (JP) ..... 2013-038908

(51) Int. Cl.
*G03G 15/20* (2006.01)

(52) U.S. Cl.
CPC ..... *G03G 15/2078* (2013.01); *G03G 15/2042* (2013.01); *G03G 2215/2016* (2013.01); *G03G 15/2003* (2013.01); *G03G 2215/2032* (2013.01); *G03G 15/2082* (2013.01)
USPC ..... 399/69

(58) Field of Classification Search
CPC ..... G03G 15/20
USPC ..... 399/67, 69
See application file for complete search history.

(56) References Cited

U.S. PATENT DOCUMENTS

| | | | | |
|---|---|---|---|---|
| 6,229,120 | B1 * | 5/2001 | Jewell | 219/486 |
| 2006/0099002 | A1 * | 5/2006 | Kim | 399/69 |
| 2011/0176818 | A1 * | 7/2011 | Yamamoto et al. | 399/12 |
| 2014/0016958 | A1 * | 1/2014 | Yabuuchi et al. | 399/69 |

FOREIGN PATENT DOCUMENTS

| | | | | |
|---|---|---|---|---|
| JP | 07-225524 | | 8/1995 | |
| JP | 1995-225524 | * | 8/1995 | G03G 15/20 |
| JP | 2005-181946 | | 7/2005 | |

* cited by examiner

*Primary Examiner* — Clayton E LaBalle
*Assistant Examiner* — Kevin Butler
(74) *Attorney, Agent, or Firm* — Oblon, McClelland, Maier & Neustadt, L.L.P.

(57) ABSTRACT

A fixing control apparatus which controls a fixing apparatus which includes multiple heating elements to fix, to a recording material, an unfixed toner image formed based on image data is disclosed. The fixing control apparatus includes an image presence/absence determining unit which determines presence/absence of an image for each of multiple areas into which the image data are divided; a heating element selecting unit which selects a heating element located at a position corresponding to an area in which the image is present from the multiple heating elements; and a heating element driving unit which causes the heating element selected by the heating element selecting unit to be heated.

5 Claims, 10 Drawing Sheets

FIXING CONTROL APPARATUS, FIXING CONTROL PROGRAM PRODUCT, AND IMAGE FORMING APPARATUS

The present application is based on and claims the benefit of priority of Japanese Priority Application No. 2012-157681 filed on Jul. 13, 2012 and Japanese Priority Application No. 2013-038908 filed on Feb. 28, 2013, the entire contents of which are hereby incorporated by reference.

TECHNICAL FIELD

The present invention relates to fixing control apparatuses which fix, onto a recording material, an unfixed toner image formed based on image data; fixing control program products; and image forming apparatuses.

BACKGROUND ART

Related-art image forming apparatuses include an image foaming apparatus provided with a fixing apparatus using a laser beam, etc., or a thermal head which has a good thermal responsiveness. In the image forming apparatus provided with the fixing apparatus, a technique is known which selectively heats only a position at which toner is put on the recording material or only the vicinity thereof to fix non-fixed toner based on digital image data (Patent Document 1).

Patent Document

Patent Document 1 JP7-225524A

In the related art described above, fixing control is performed using write control data based on the digital image data. However, handling of the write control data is difficult, since an amount of data thereof is large.

DISCLOSURE OF THE INVENTION

The present invention is made to solve the problems described above in light thereof.

An object of the present invention is to provide a fixing control apparatus, a fixing control program product, and an image forming apparatus that make it possible to reduce an amount of data used in fixing control so as to fix toner efficiently.

According to an embodiment of the present invention, a fixing control apparatus which controls a fixing apparatus which includes multiple heating elements to fix, to a recording material, an unfixed toner image famed based on image data is provided, including an image presence/absence determining unit which determines the presence/absence of an image for each of multiple areas into which the image data are divided; a heating element selecting unit which selects a heating element located at a position corresponding to an area in which the image is present from the multiple heating elements; and a heating element driving unit which causes the heating element selected by the heating element selecting unit to be heated.

According to another embodiment of the present invention, a fixing control program product which is to be executed by a fixing control apparatus which controls a fixing apparatus which includes multiple heating elements to fix, to a recording material, an unfixed toner image formed based on image data is provided, the fixing control program product including the step of causing the fixing control apparatus to execute the image presence/absence determining step which determines presence/absence of an image for each of multiple areas into which the image data are divided;

a heating element selecting step of selecting a heating element located at a position corresponding to an area in which the image is present from the multiple heating elements; and a heating body driving step of causing the heating element selected in the heating element selecting step to be heated.

According to a further embodiment of the present invention, an image forming apparatus is provided, including a fixing control apparatus which controls a fixing apparatus which includes multiple heating elements to fix, to a recording material, unfixed toner image formed based on image data, wherein the fixing control apparatus includes an image presence/absence determining unit which determines presence/absence of an image for each of multiple areas into which the image data are divided; a heating element selecting unit which selects a heating element located at a position corresponding to an area in which the image is present from the multiple heating elements; and a heating element driving unit which causes the heating element selected by the heating element selecting unit to be heated.

Embodiments of the present invention make it possible to reduce an amount of data handled at a time of fixing control and to fix toner efficiently.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Figure 1:
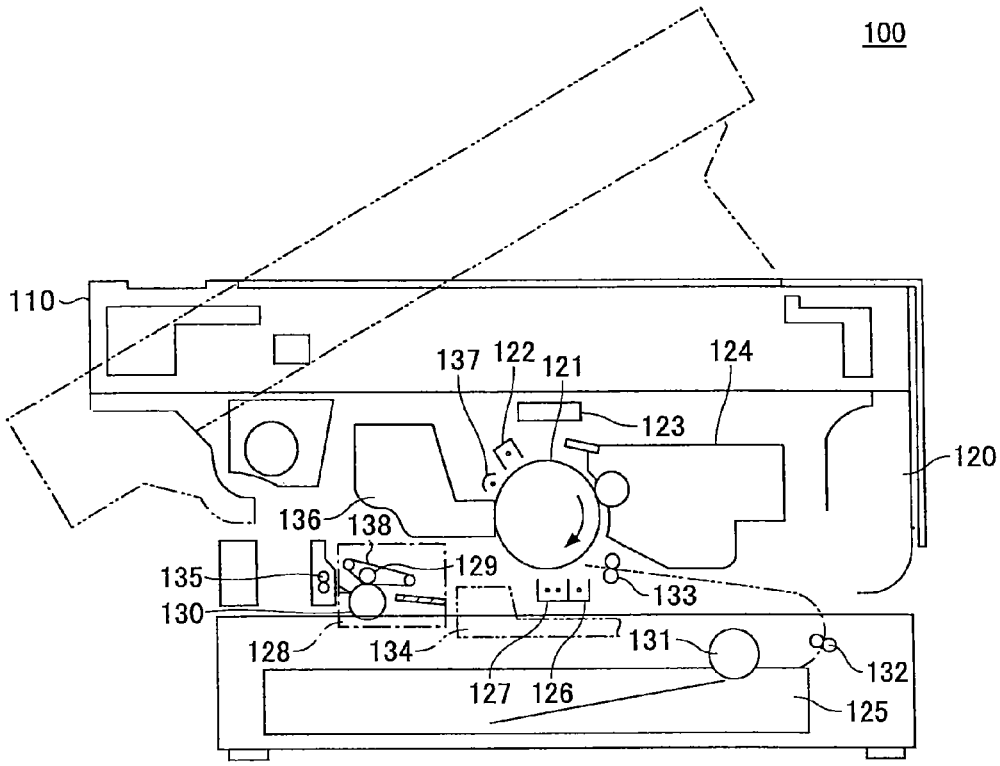
FIG. 1 is a diagram illustrating a schematic configuration of an image forming apparatus according to the present embodiment.

A description is given below with regard to embodiments of the present invention with reference to the drawings. FIG. 1 is a diagram illustrating a schematic configuration of an image forming apparatus according to the present embodiment.

An image forming apparatus 100 according to the present embodiment includes a scanner unit 110 and a printer unit 120. In the image forming apparatus 100 of the present embodiment, the scanner unit 110 converts a reflected light of a read manuscript (not shown) into an electrical signal and further converts an analog electrical signal into a digital image signal to output the converted result to the printer unit 120. Based on image data input from the scanner unit 110 or image data transmitted from a computer, etc., connected to the image forming apparatus 100, the printer unit 120 performs an image forming operation.

The printer unit 120 according to the present embodiment includes a photoreceptor drum 121, a charger 122, a write apparatus 123, a developing apparatus 124, a paper-feeding apparatus 125, a transfer apparatus 126, a separating apparatus 127, a fixing apparatus 128, etc.

In the present embodiment, the photoreceptor drum 121 is uniformly charged by the charger 122. The image data input into the image forming apparatus 100 undergo processes such as various conversions, magnification changes, etc., and various corrections, after which the processed image data are input into the write apparatus 123. Based on image data input, the write apparatus 123 irradiates a laser light into the photoreceptor drum 121 based on input image data. An electrostatic latent image formed on the photoreceptor drum 121 is developed by thermally soluble toner by the developing apparatus 124 and turned into a visible image. On the other hand, a recording material (not shown) is fed by a paper-feeding roller 131 from the paper-feeding apparatus 125 and conveyed to a regist roller 133 via a conveying roller 132. The regist roller 133 sends out the recording material in synchronization with a toner image on the photoreceptor drum 121. Onto this recording material, the toner image on the photoreceptor drum 121 is transferred by an action of the transfer apparatus 126.

Then, the recording material is separated from the photoconductor drum 121 by an action of the separating apparatus 127 and directed to the fixing apparatus 128, being guided by a conveying guide 134. An unfixed toner image on the recording material is heated and fixed by the fixing apparatus 128 and the recording material is discharged out the machine by a paper-discharging roller 135. Moreover, in the photoreceptor drum 121, after separating the recording material, residual toner is removed by a cleaning apparatus 136 and residual charges are erased by a discharger 137.

In the image forming apparatus 100 according to the present embodiment, image data input into the write apparatus 123 are used to perform fixing control in the fixing apparatus 128. In other words, the image forming apparatus 100 according to the present embodiment forms, on the recording material, the toner image formed on the photoreceptor drum 121 based on the image data.

Below, the fixing apparatus 128 of the present embodiment is explained. The fixing apparatus 128 according to the present embodiment includes a fixing roller 129 and a pressurizing roller 130, and a fixing belt 138. In the fixing apparatus 128 according to the present embodiment, the recording material is placed between the fixing roller 129 and the pressurizing roller 130 and conveyed therebetween, so that the unfixed toner image is fixed onto the recording material.

Figure 2A:
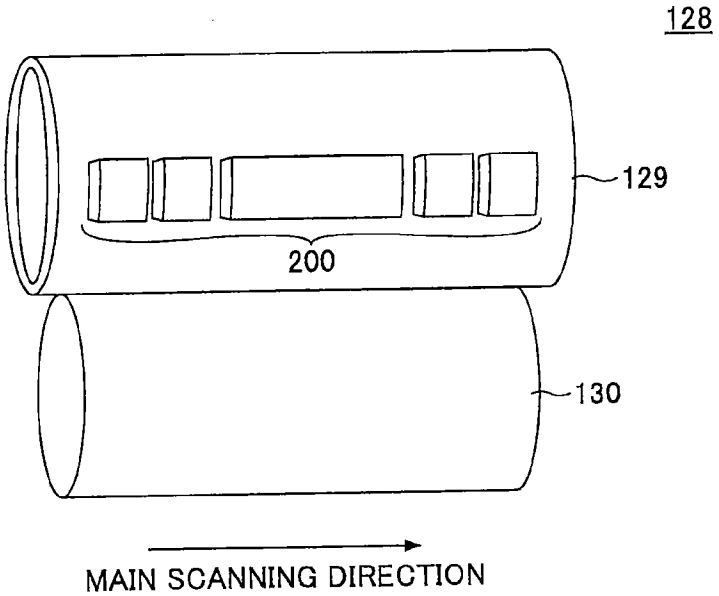
FIGS. 2A and 2B are diagrams for explaining a fixing roller according to the present embodiment.
Figure 2B:
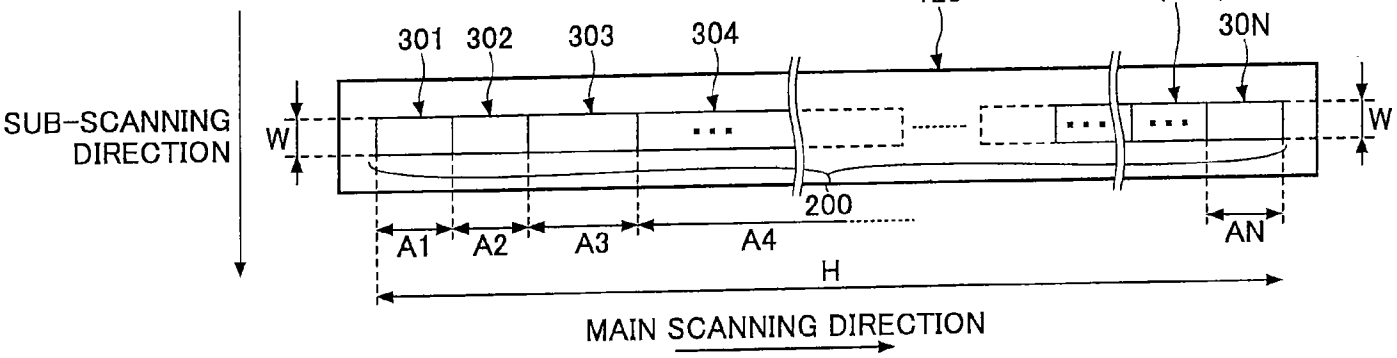

FIGS. 2A and 2B are diagrams for explaining a fixing roller according to the present embodiment. FIG. 2A is a diagram for explaining a schematic configuration of the fixing roller 129, while FIG. 2B is a diagram for explaining a heating element 200.

Inside the fixing roller 129 according to the present embodiment is provided the heating element 200. The heating element 200 includes multiple heating elements 30N, for example.

The heating element 200 is explained with reference to FIG. 2B. The heating element 200 according to the present embodiment includes the multiple heating elements 30N. The multiple heating elements 30N according to the present embodiment may have respectively different sizes or respectively the same size. In an example in FIG. 2B, an example is shown in which the respective heating elements 30N have different sizes. More specifically, the respective widths of the heating elements N in the main scanning direction differ.

In the present embodiment, a width A4 in a main scanning direction of a heating element 304 which is located at a center portion in a main scanning direction of the fixing roller 129 is set to be wider than a width AN in a main scanning direction of the heating element 30N near an end portion of the fixing roller 129. More specifically, a width A1 of a heating element 301 which is at one end portion in the main scanning direction of the fixing roller 129, a width A2 of a heating element 302, and a width AN of the heating element 30N which is at the other end portion in the main scanning direction of the fixing roller 129 are narrower than the width A4 of the heating element 304. A width A3 in the main scanning direction of a heating element 303 is set to be wider than the width A2 in the main scanning direction of the heating element 302 and narrower than the width A4 in the main scanning direction of the heating element 304.

At the center portion in the main scanning direction of the fixing roller 129, there is a large possibility that the unfixed toner image is foamed. Therefore, in the present embodiment, the heating element 304 with a wide width in the main scanning direction is arranged at the center portion. The heating element may be arranged in this way to reduce the number of heating elements 30N to be arranged and to simplify control of the heating element 30N. Moreover, in the present embodiment, a width of the heating element at both end portions in the main scanning direction of the fixing roller 129 is set to be narrower than a width of the heating element arranged at a center portion in the main scanning direction. In this way, in both end portions in the main scanning direction of the recording material, the heating element may be left turned off in correspondence with a region in which the unfixed toner image is not formed.

The heating element 30N according to the present embodiment heats a region of a length W in a sub-scanning direction x the same width as a width AN in the main scanning direction in the fixing roller 129. In the present embodiment, the length W in the sub-scanning direction of the respective heating elements 30N is set to be all the same. In the present embodiment, it is preferable that the number and the width AN in the main scanning direction of the heating elements 30N is determined such that a width H in the main scanning direction of the heating element 200 and a width in the main scanning direction of the recording material match. The respective heating elements are controlled such that they are individually turned on and turned off.

The multiple heating elements 30N according to the present embodiment may be realized by a thermal head array, an IH (induction heating) coil, etc., for example.

Figure 3:
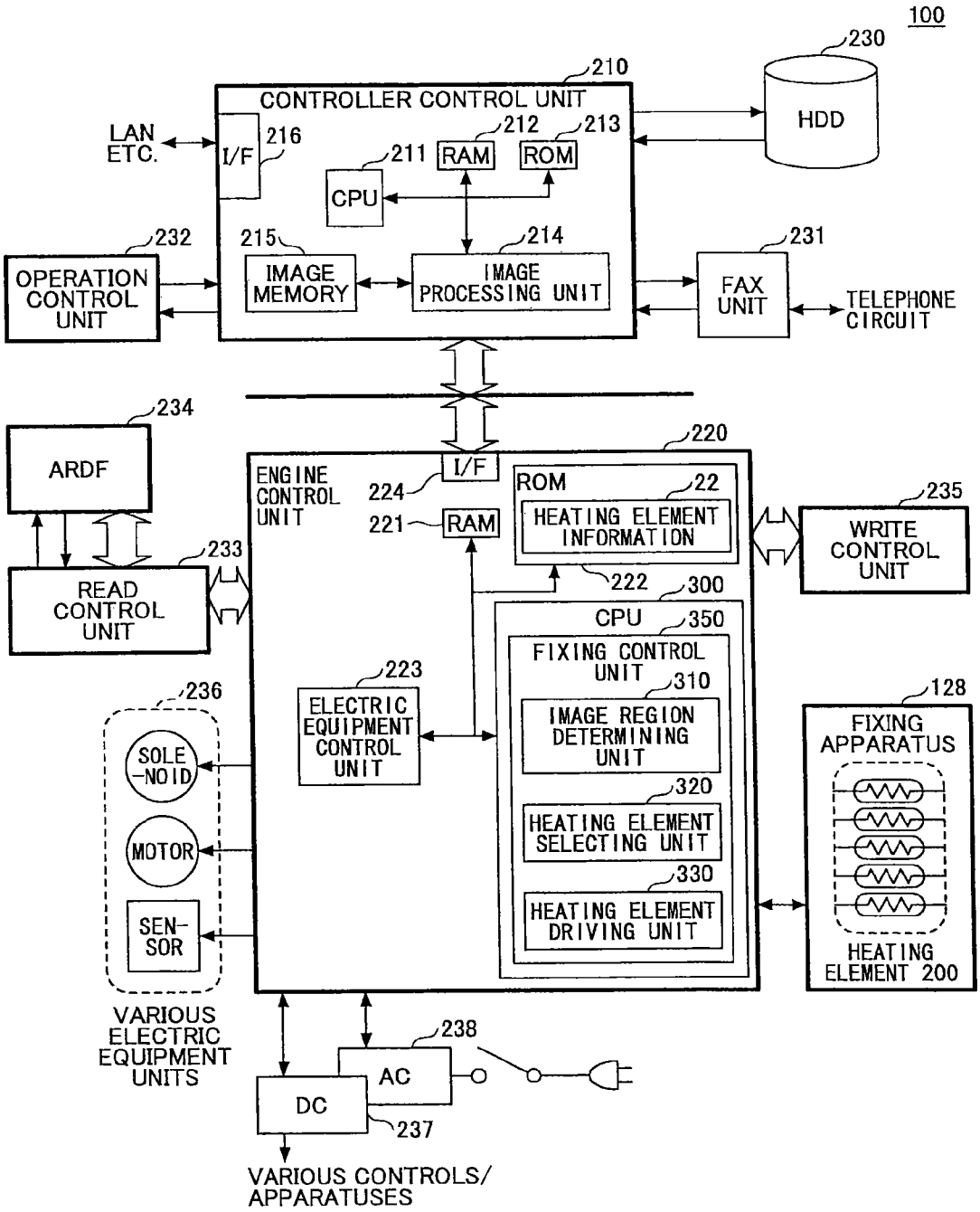
FIG. 3 is a diagram for explaining the configuration of the image forming apparatus according to the present embodiment.

Next, a configuration of the image forming apparatus 100 according to the present embodiment is explained. FIG. 3 is a diagram for explaining a configuration of the image forming apparatus according to the present embodiment.

The image forming apparatus 100 according to the present embodiment includes a controller control unit 210, an engine control unit 220, an HDD (hard disk drive) 230, a FAX unit 231, an operation control unit 232, a read control unit 233, an ARDF (automated reverse double-sided manuscript sending apparatus) 234, a write control unit 235, electric equipment units 236, a DC (direct current) power supply 237, an AC (alternating current) power supply 238, etc.

The controller control unit 210 according to the present embodiment accepts designation of an image forming operation and sets the image forming operation. More specifically, the controller control unit 210 manages control, etc., of applications such as image forming, user interfacing, mode setting, copying, printer, etc.

The engine control unit 220 performs drive control, etc., of a printer engine.

In the HDD 230, data, etc., to be processed are stored, for example. The FAX unit 231 realizes a FAX function in the image forming apparatus 100. The operation control unit 232 performs control such as a touch panel (an operating unit) to be a user interface.

The read control unit 233, which controls the scanner unit 110, transmits an image read via a PCI (peripheral component interconnect) bus to an image processing unit 214 of the controller control unit 210.

The write control unit 235 transmits image data sent via the PCI bus from the controller control unit 210 and the read control unit 233 to an LED (light emitting diode) unit and an LD (laser diode) unit performing image forming to perform an operation such as writing a pattern to a sheet and an operation such as printing and copying.

The various electric equipment components 236 include, for example, a temperature sensor, a motor, a solenoid, etc. The DC power supply 237 and the AC power supply 238 provide power to the respective control units.

Next, a configuration of the controller control unit 210 according to the present embodiment is explained. The controller control unit 210 according to the present embodiment includes a CPU (central processing unit) 211, a RAM (random access memory) 212, a ROM (read-only memory) 213, an image processing unit 214, an image memory 215, and an I/F (interface) 216.

The CPU 211 performs various processing operations. The RAM 212 temporally stores various information sets. The ROM 213 stores control programs in a fixed manner. The image processing unit 214 is realized by an ASIC (application specific integrated circuit), etc., which performs image processing, for example. In the image memory 215, image data processed by the image processing unit 214 is stored. Moreover, the controller control unit 210 according to the present embodiment may include an NVRAM (non-volatile RAM) (not shown), etc., in which NVRAM may be stored setting information on operating conditions, etc., of the image forming apparatus 100.

The controller control unit 210 according to the present embodiment is connected to the HDD 230 which stores predetermined data to be processed; the operation control unit 232 to be a user interface; the interface 216 which transmits and receives information via an LAN (local area network), etc., via a network from an external communications equipment unit.

The controller control unit 210 according to the present embodiment is connected by a PCI bus with the interface 216, the engine control unit 220, and the FAX unit 231. The controller control unit 210 accepts instructions for an image foaming operation via the interface 216 from an external equipment unit or the operation control unit 232, executes the image forming operation, and transmits the formed image to the engine control unit 220 via the PCI bus.

The engine control unit 220 according to the present embodiment includes a CPU 300, a RAM 221, a ROM 222, and an electric equipment control unit 223. The CPU 300 performs various operations of the engine control unit 220. Moreover, the CPU 300 of the present embodiment performs fixing control by the fixing apparatus 128. Details of fixing control by the CPU 300 will be described below.

The RAM 221 temporally stores various information sets. In the ROM 222 are stored control programs. In the present embodiment, fixing control programs may be stored in the ROM 222. Moreover, in the ROM 222 of the present embodiment may be stored heating element information 22 which is described below. The electric equipment control unit 223 controls the electric equipment units 236.

Below, functions of the CPU 300 will be explained. The CPU 300 according to the present embodiment includes a fixing control unit 350.

The fixing control unit 350 includes an image region determining unit 310, a heating element selecting unit 320, and a heating element driving unit 310. With image data received from the controller control unit 210 being set to be data for each predetermined region (area), the image region determining unit 310 determines presence/absence of an image in each area. Details of processing of the image region determining unit 310 will be described below. The heating element selecting unit 320 selects the heating element 30N to be actually heated in accordance with an area in which the image is present. The heating element driving unit 330 drives and heats the heating element 30N selected.

In other words, in the image forming apparatus 100 according to the present embodiment, with image data output from the image processing unit 214 being set to be data for each predetermined area which is pre-set by the image region determining unit 310, presence/absence of an image for each area is determined. Next, the heating element selecting unit 320 selects the heating element 30N corresponding to an area in which the image is present and allocates the area to the corresponding heating element 30N. The heating element driving unit 330 drives and heats the heating element 30N selected.

As a function not shown, the image forming apparatus 100 according to the present embodiment also includes a heating element temperature monitoring function by a temperature sensor which monitors a temperature state of the heating element 200.

Moreover, while the present embodiment is configured to install the image region determining unit 310 within the engine control unit 220, the image region determining unit 310 may be installed within the image processing unit 214 of the controller control unit 210. In this case, results of processing by the image region determining unit 310 may be reported from the controller control unit 210 to the engine control unit 220.

Figure 4:
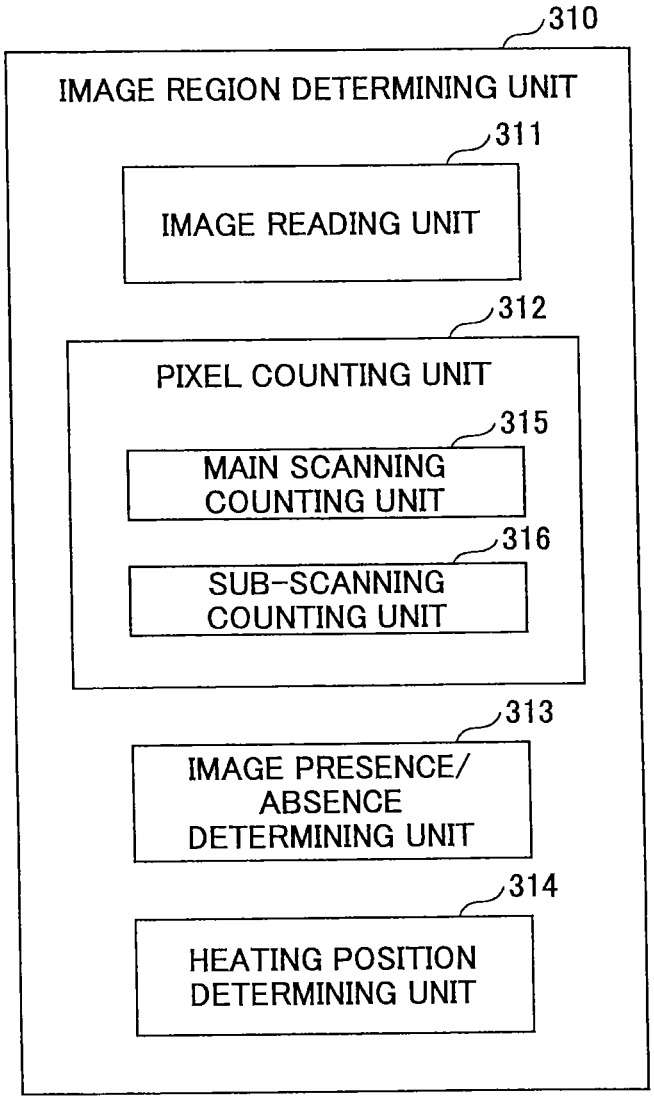
FIG. 4 is a view for explaining a function of an image region determining unit.

Next, with reference to FIG. 4, details of processing of the image region determining unit 310 of the present embodiment are explained. FIG. 4 is a view for explaining a function of the image region determining unit.

The image region determining unit 310 of the present embodiment includes an image reading unit 311, a pixel counting unit 312, an image presence/absence determining unit 313, and a heating position determining unit 314.

Into the image reading unit 311 according to the present embodiment are read image data which are input via the controller control unit 210. The image data read into may be temporarily stored into the RAM 221 within the engine control unit 220.

The pixel counting unit 312 counts pixels of the image data. Details of the pixel counting unit 312 will be described below.

The image presence/absence determining unit 313 determines presence/absence of an image within an area for each predetermined area included in the image data. Details of determining by the image presence/absence determining unit 313 will be described below. The heating position determining unit 314 determines the heating element 30N corresponding to an area in which the image is present to be a heating position.

Below, the pixel counting unit 312 is described.

The pixel counting unit 312 according to the present embodiment includes a main scanning counting unit 315 and a sub-scanning counting unit 316. The main scanning counting unit 315 counts pixels in the main scanning direction of the image data. The sub-scanning counting unit 316 counts pixels in the sub-scanning direction of the image data.

When the image reading unit 311 reads in the image data, the pixel counting unit 312 of the present embodiment counts pixels in the main scanning direction by the main scanning counting unit 315. In other words, the main scanning counting unit 315 counts a width of one line in the image data. The sub-scanning counting unit 316 counts pixels in the sub-scanning direction of the image data. In other words, the sub-scanning counting unit 316 counts the number of lines in the image data.

The image region determining unit 310 according to the present embodiment counts pixels in the respective main scanning and sub-scanning directions by the pixel counting unit 312 to determine the image data as a set of areas set in advance.

Figure 5:
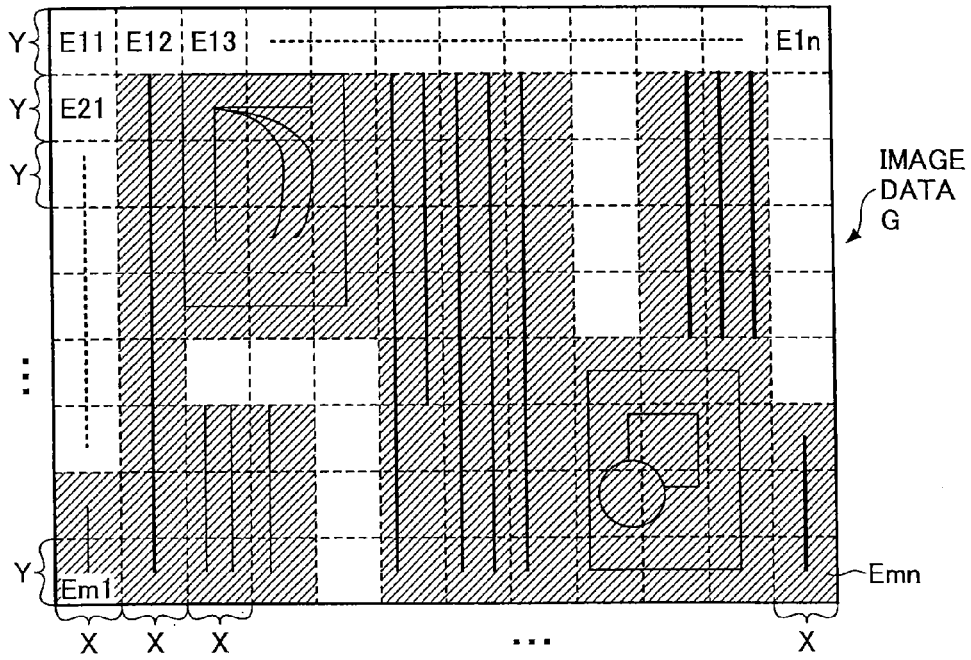
FIG. 5 is a diagram which explains determining of an area in image data.

Below, determining of an area according to the present embodiment is described with reference to FIG. 5. FIG. 5 is a diagram which explains determining of the area in image data.

In the present embodiment, image data are grasped as a set Emn of m rows×n columns of a predetermined area E which is set in advance. In the present embodiment, the predetermined area E is set to be a region of X×Y. Units of X and Y are both millimeters.

Moreover, in the present embodiment, a register corresponding to each predetermined area E is provided in a storage region which the CPU 300 has, for example. In an example in FIG. 5, the image data are a set of m rows×n columns of the area E, so that a register corresponding to the respective areas E11 to Emn is provided in the storage area of the CPU 300. Into this register is stored a count value by the pixel counting unit 312.

The pixel counting unit 312 according to the present embodiment starts counting pixels of image data in order, starting from upper left of the image data.

The main scanning counting unit 315 of the pixel counting unit 312 counts pixels in the main scanning direction from upper left of the image data G shown in FIG. 5 and stores a count value for each pixel into a register corresponding to each area E.

For example, the main scanning counting unit 315 starts counting pixels on a first line from upper left of the image data G. Here, the pixel counted is a pixel within an area E11. Therefore, the main scanning counting unit 315 stores a count value into a register corresponding to the area E11. In other words, until pixels are counted which correspond to X millimeters in the main scanning direction, the main scanning counting unit 315 stores the count value in a register corresponding to the area E11. Therefore, a value of a register becomes a sum of count values of pixels which form the first line within the area E11.

Next, when pixels to be counted becomes pixels within an area E12, the main scanning counting unit 315 stores the count value into a register corresponding to the area E12. Then, until pixels are counted which correspond to X millimeters in the main scanning direction from the first pixel within the area E12, the main scanning counting unit 315 stores the count value in the register corresponding to the area E12. Therefore, a value of the register becomes a sum of count values of pixels which form the first line within the area E12.

Similarly, when the main scanning counting unit 315 counts one line, or, in other words, what corresponds to X×n millimeters in the main scanning direction, the sub-scanning counting unit 316 counts the number of lines counted in the sub-scanning direction. In the case, the number of lines is 1. Thus, here, into the register corresponding to areas E11 to E1*n* is stored a sum of count values of pixels on the first line of the respective areas E11 to areas E1*n*.

When one line count is completed, the main scanning counting unit 315 resumes counting from a pixel on the left end of the following line. The main scanning counting unit 315 starts counting from a pixel on the left end of the second line, and performs the same process thereon as on the first line.

In the present embodiment, when the sub-scanning counting unit 316 finishes counting the number of lines corresponding to Y millimeters in the sub-scanning direction, pixels within respective regions of X millimeters×Y millimeters are counted for the areas E11 to E1*n*. Here, into the register corresponding to the areas E11 to E1*n* is stored a cumulative value of count values of all pixels within the E11 to areas E1*n*.

In the present embodiment, the same process is performed on areas E21 and thereafter, and a cumulative value of count values of pixels of the respective areas E11 to Emn is obtained.

In other words, the image region determining unit 310 according to the present embodiment obtains a cumulative value of pixel count values for each area when image data are divided into areas of X millimeters×Y millimeters.

The present embodiment may include the same number of registers as the number of areas included in the image data G. In this case, the number of registers is m×n. Moreover, in the present embodiment, the number of registers may be set to be n, which is the same as the number of areas provided in the main scanning direction. In this case, when counting to the area E1*n* is finished, the CPU 300 may temporarily store, in the RAM 222, etc., a value stored in n registers and erase the values stored in all of the registers. The number of registers in the present embodiment may be determined in accordance with a size of the area E and a width of image data (in other words, a width of a recording material). For example, the number of registers when the maximum width of recording materials which can be printed in the image forming apparatus 100 is set to W10 millimeters, for example, may be at least W10 millimeters/X millimeters.

As described below, the count value stored in the register of the present embodiment is used only for determining presence/absence of an image for each area.

Therefore, in the present embodiment, a size of each register may be at least two bits.

In the present embodiment, it is set such that X=Y=2 millimeters. In other words, in the present embodiment, the image data becomes a set of areas of 2 millimeters×2 millimeters.

In the present embodiment, the value of X may be set to be the same value as a width of the heating element 30N with the narrowest width, in the main scanning direction, of the multiple heating elements 30N, for example.

Moreover, the value of Y in the present embodiment may be set such that V>Y/t1 when the conveying speed of the recording material in the image forming apparatus 100 is set to be V and a heating response time of the heating element 30N is set to be t. The heating response time is a time from when heating of the heating element 30N is started to when a temperature of the fixing roller 129 reaches a predetermined temperature which has been pre-set for fixing toner onto the recording material. In this way, determining a value of Y causes the heating response time to be sufficiently short relative to a time that the recording material is conveyed to a fixing position, making it possible to cause the fixing roller 129 to reach a predetermined temperature at a time of fixing.

Figure 6:
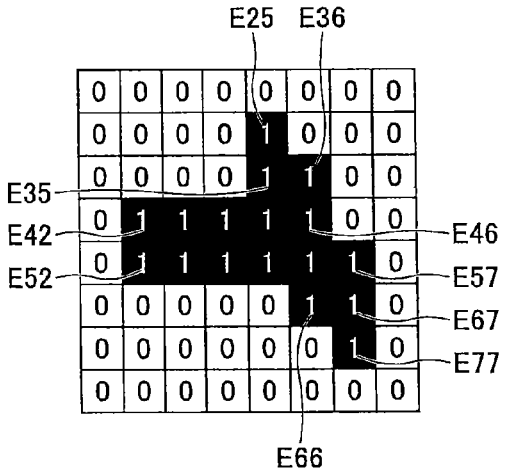
FIG. 6 is a view for explaining determining by an image presence/absence determining unit.

Below, with reference to FIG. 6, determination of presence/absence of an image by the image presence/absence determining unit 313 is explained. FIG. 6 is a view for explaining determination by the image presence/absence determining unit.

The image presence/absence determining unit 313 according to the present embodiment determines presence/absence of an image within each area based on a value of a register in which a cumulative value of a count value of each area is stored by the pixel counting unit 312. More specifically, the image presence/absence determining unit 313 determines that a corresponding area is a non-image region with an image being absent when the value of the register is 0. Moreover, the image presence/absence determining unit 313 determines that the corresponding area is an image region with the image being present when the value of the register is not 0. The non-image region is a region with an image (unfixed toner) being absent and in which heating for fixing is unnecessary. The image region is a region with the image (unfixed toner) being present and a region which is to be heated by the heating element 30N.

While the area thereof is determined to be the non-image region when a sum of the count values is 0 in the present embodiment, the area may be determined to be the non-image region when the count value is less than or equal to a predetermined value which is pre-set, for example.

The heating position determining unit 314 according to the present embodiment determines the image region to be a heating position. In an example in FIG. 6, it is seen that areas E25, E35, E36, E42-E46, E52-E57, E66, E67, and E77 are the image regions. Thus, the heating position determining unit 314 determines these image regions to be the heating position. When the heating position is determined, the heating element selecting unit 320 according to the present embodiment selects the heating element 30N corresponding to the heating position and heats the image region to be heated by the selected heating element 30N.

Next, temperature control of the fixing apparatus 128 at a time of image forming by the image forming apparatus 100 according to the present embodiment is explained.

Figure 7:
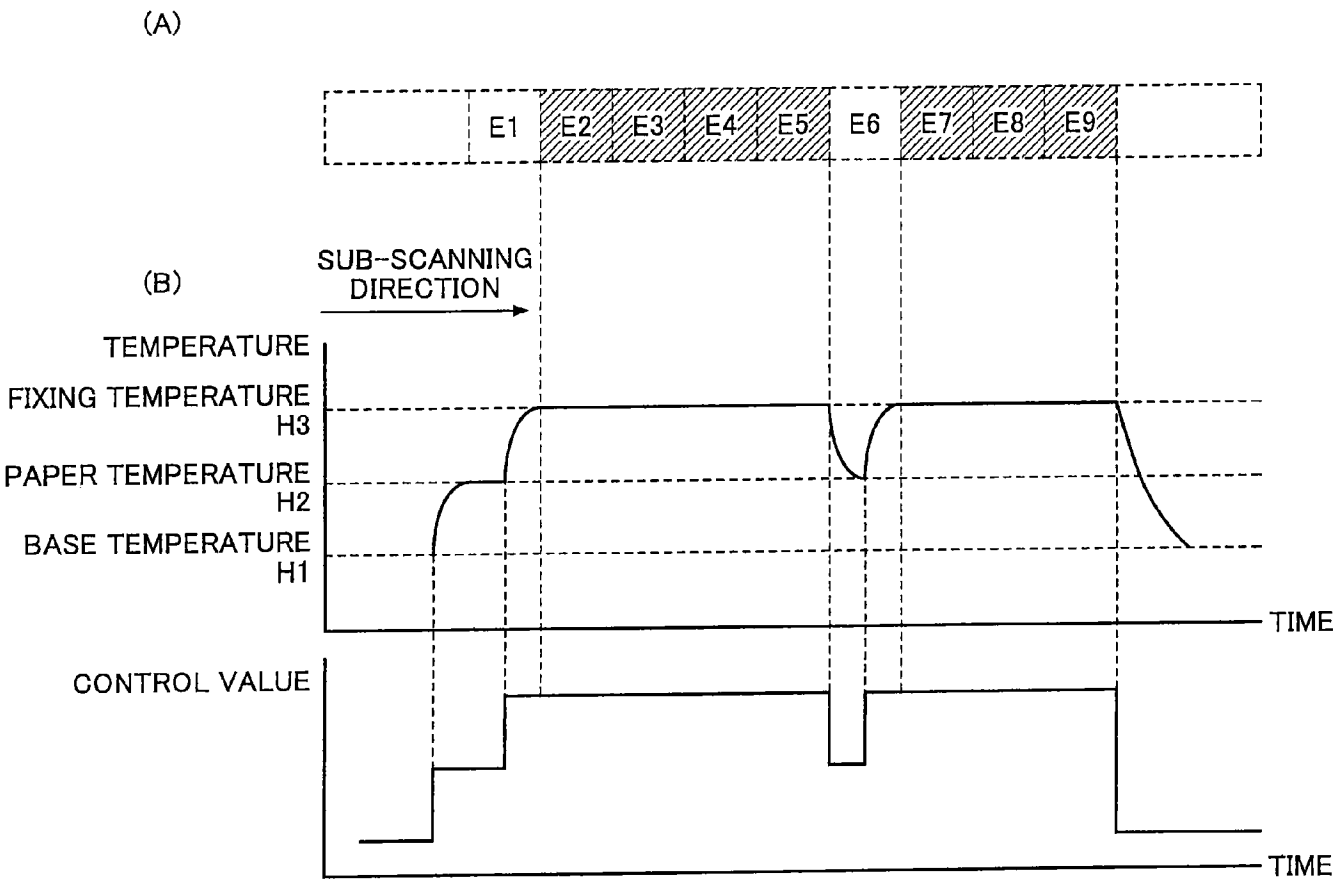
FIG. 7 is a diagram for explaining temperature control of a fixing apparatus at a time of image forming.

FIG. 7 is a diagram for explaining temperature control of a fixing apparatus at the time of image forming.

The fixing control unit 350 of the image forming apparatus 100 according to the present embodiment pre-sets three temperature regions by the heating element driving unit 330 to perform temperature control when performing fixing by the fixing apparatus 128. The three temperature regions are a base temperature region, a paper temperature region, and a fixing temperature region. The base temperature region is a temperature region which is less than or equal to a base temperature H1. A temperature of the heating element 200 including multiple heating elements 30N becomes a temperature within the base temperature region when the image forming apparatus 100 does not perform an image forming operation. In the present embodiment, a temperature sensor which detects a temperature of the heating element 200 is provided, which temperature is detected by a heating element temperature monitoring function provided in the image forming apparatus 100.

A paper temperature region is a region of a temperature which is higher than the base temperature H1 and less than or equal to a paper temperature H2. In the present embodiment, when the image forming apparatus 100 receives a printing request, a temperature of the heating element 200 is increased up to within the paper temperature region, and the heating element 200 is heated such that the temperature of the heating element 200 reaches the paper temperature H2 when the recording material is detected.

The fixing temperature region is a temperature region which is higher than the paper temperature H2. In the present embodiment, when fixing is started in image forming, only the heating element 30N selected as what is to be heated is heated out of the multiple heating elements 30N included in the heating element 200 is heated to reach the fixing temperature H3.

In other words, in the present embodiment, the multiple heating elements 30N included in the heating element 200 are heated to the paper temperature H2. Then, when the fixing is started, only the selected heating element 30N is further heated to reach the fixing temperature H3.

FIG. 7, in (A), shows an example of an area, while FIG. 7, in (B), shows an example of a temperature of the heating element 200 and a driving signal which heats the heating element 200.

In the example in FIG. 7, areas E2 to E5 and areas E7 to E9 are image regions. Thus, the heating elements 30N which heat the areas E2 to E5 and the areas E7 to E9 are heated to the fixing temperature H3. The other areas (areas E1 and E6) are non-image regions. Thus, the heating element 30N corresponding to areas E1 and E6 reaches a temperature which is less than or equal to the paper temperature H2.

Figure 8:
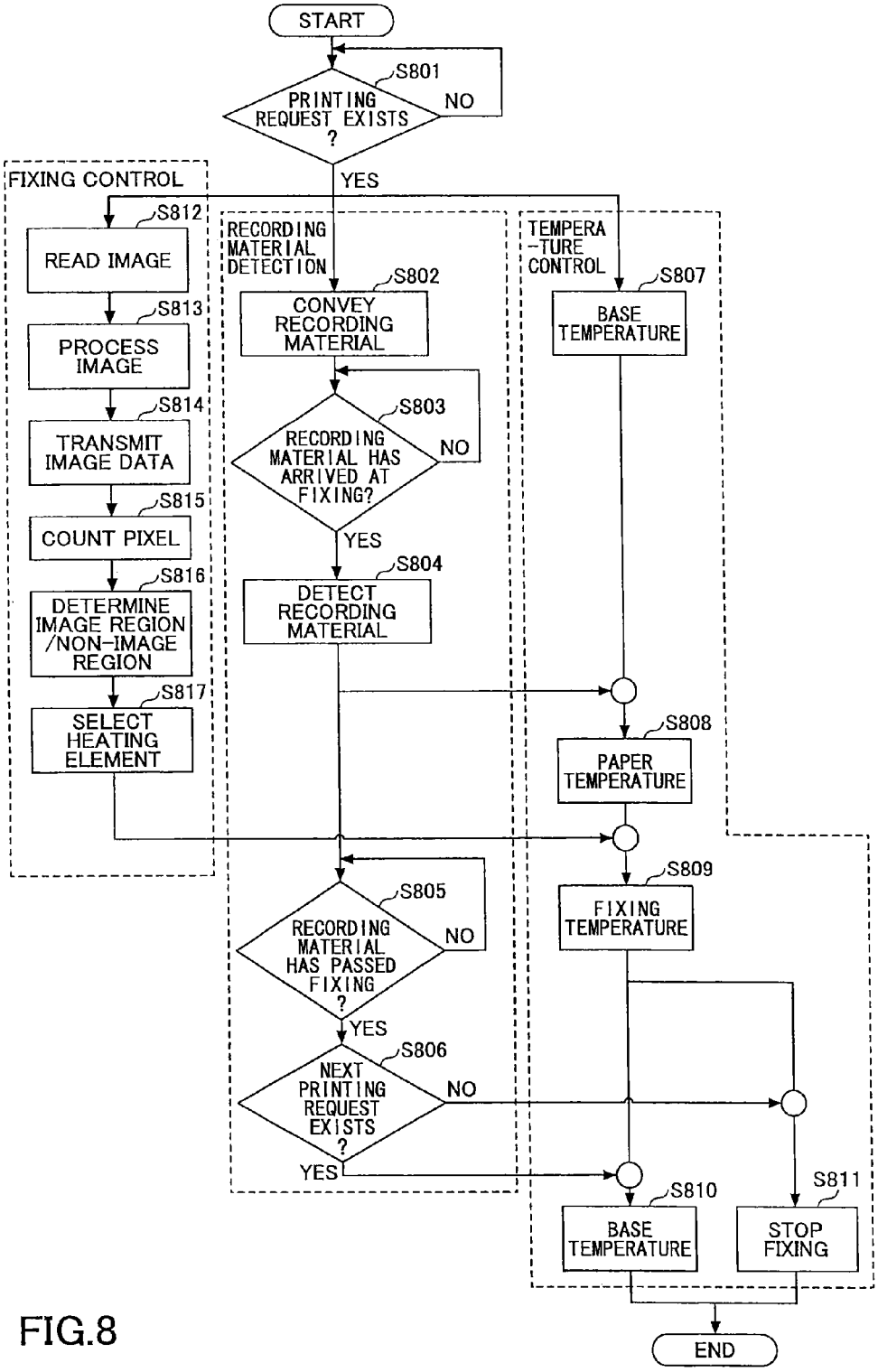
FIG. 8 is a flowchart for explaining an operation of the image forming apparatus.

Next, an operation of the image forming apparatus 100 of the present embodiment is explained with reference to FIG. 8. FIG. 8 is a flowchart which explains an operation of the image forming apparatus.

When the image forming apparatus 100 of the present embodiment accepts a printing request (step S801), the fixing control process, a recording material detection process, and a temperature control process are performed in parallel. The fixing control process is executed by the fixing control unit 350 of the CPU 300 and the controller control unit 210. The temperature control process is executed by the fixing control unit 350 of the CPU 300. The recording material detection process is executed by the electric equipment control unit 223.

First, a recording material detection process is explained.

In the image forming apparatus 100 in the present embodiment, the electric equipment control unit 223 starts conveying the recording material (step S802). Next, the electric equipment control unit 223 determines whether the recording material reached the fixing apparatus 128 (step S803). In the present embodiment, an arrival detecting sensor which detects an arrival of the recording material is provided in the fixing apparatus 128, for example, so that the arrival of the recording material to the fixing apparatus 128 may be detected by the arrival detecting sensor. In step S803, when the recording material reaches the fixing apparatus 128, the electric equipment control unit 223 outputs the recording material detecting signal to the CPU 300 (step S804). When the recording material is detected, the fixing control unit 350 in the CPU 300 proceeds to the below-described step S808.

Moreover, when the recording material is detected, the electric equipment control unit 223 determines whether the recording material passed through the fixing apparatus 128 (step S805). In the present embodiment, a passing detecting sensor which detects whether the recording material passed through the fixing apparatus 128 may be provided, for example, so that the passing of the recording material from the fixing apparatus 128 may be detected by the passing detecting sensor. When the recording material passes through the fixing apparatus 128 in step S805, the electric equipment control unit 223 determines presence/absence of the next printing request (step S806). When the next printing request is present in step S806, the process proceeds to the below-described step S810. When the next printing request is absent in step S806, the process proceeds to the below-described step S811.

Next, the temperature control process is explained.

When the printing request is accepted, the fixing control unit 350 according to the present embodiment heats the heating element 200 by the heating element driving unit 330 to the base temperature H1 (step S807). Next, as the printing request has been accepted, the fixing control unit 350 further heats the heating element 200 by the heating element driving unit 330 to the paper temperature H2 (step S808).

Next, the fixing control unit 350 heats the heating element 30N selected in the below-described step S817 to the fixing temperature H3 (step S809). When the heating element 30N reaches the fixing temperature H3, un-fixed toner is fixed to the recording material.

Next, the fixing control unit 350 maintains the temperature of the heating element 200 to the base temperature H1 when the next printing request is present (step S810). Moreover, when the next printing request is absent, the fixing control unit 350 stops heating of the heating element 200 and stops fixing (step S) (811).

Next, the fixing control process is explained.

The image forming apparatus 100 according to the present embodiment reads, by the controller control unit 210, image data (step S812). Next, the controller control unit 210 performs image processing on image data read by the image processing unit 214 (step S813). Image processing by the image processing unit 214 is image processing required for outputting image data from the printer unit 120.

Next, the controller control unit 210 transmits image-processed image data to the CPU 300 (step S814). Next, in the fixing control unit 350 of the CPU 300, the image region determining unit 310 counts pixels of the image data received from the controller control unit 310 and determines the image data to be a set of predetermined areas (step S815). In other words, the image region determining unit 310 according to the present embodiment divides the image data into image data of the predetermined areas. A method of counting the pixels is as described above.

Next, the image region determining unit 310 determines, for all the areas in the image data, whether it is an image region or a non-image region (step S816).

Next, the fixing control unit 350 allocates the image region into the multiple heating elements 30N and selects the heating element 30N to which the image region is allocated (step S817) and proceeds to step S809. Details of the process in step S817 are described below.

Figure 9:
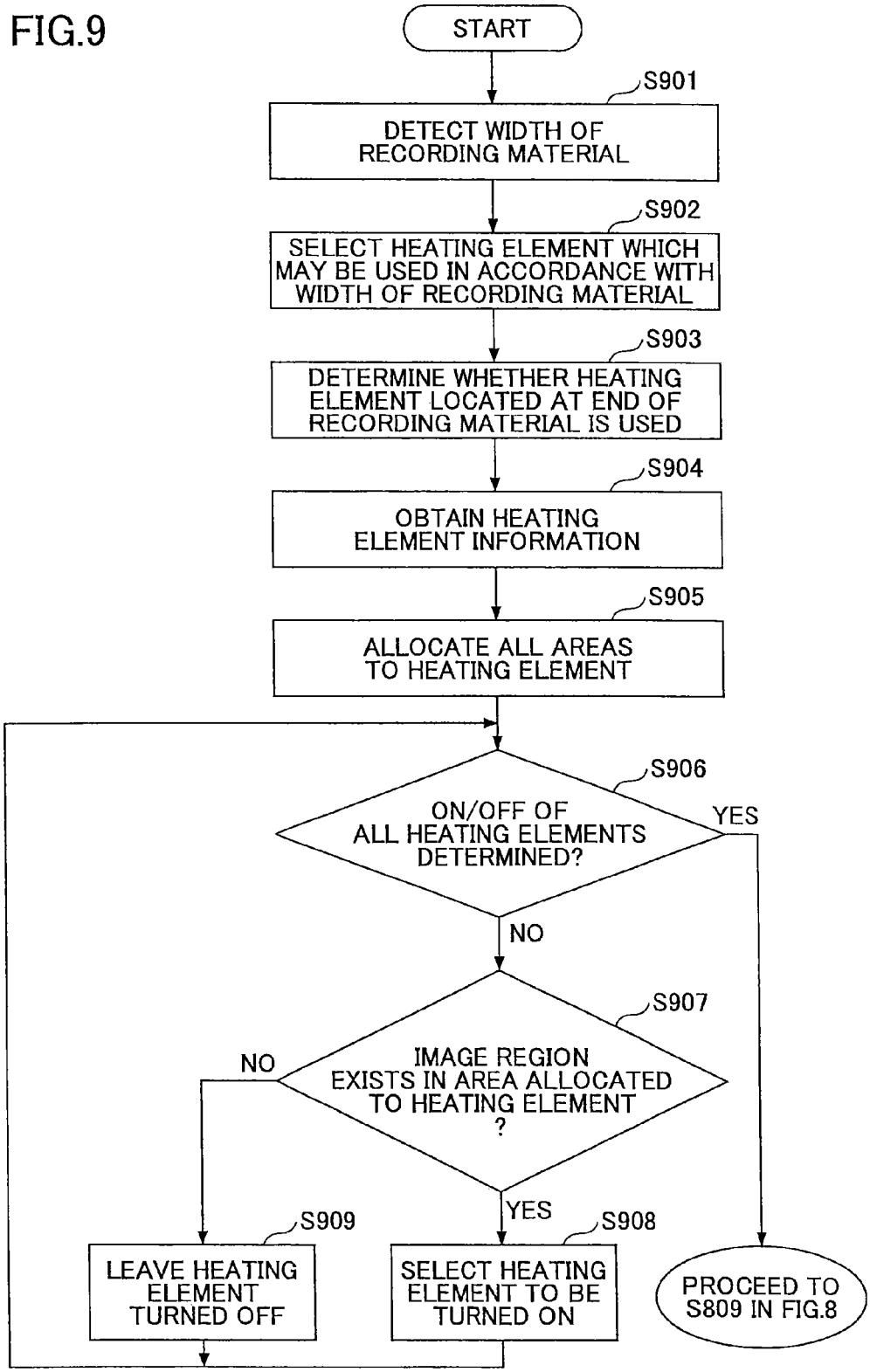
FIG. 9 is a flowchart for explaining a process of a heating element selecting unit.

Below, with reference to FIG. 9, details of processing of the heating element selecting unit 320 of the present embodiment are explained. FIG. 9 is a flowchart for explaining a process of a heating element selecting unit. Processing in FIG. 9 shows details of processing in step S817 in FIG. 8.

The heating element selecting unit 320 according to the present embodiment detects a width of the recording material (step S901). The width of the recording material may be detected by an arrival detecting sensor, etc., which is provided in the fixing apparatus 128 when the recording material arrives at the fixing apparatus 128, for example.

Next, the heating element selecting unit 320 selects the heating element 30N for use in accordance with the width of the recording material (step S902). More specifically, when the recording material is arranged at the center portion of the heating element 200 and the recording material corresponding to both end portions of the heating element 200 is not present, for example, the heating element 30N for which corresponding recording material is absent is not used. For example, in the heating element 200 as shown in FIGS. 2A and 2B, when a recording material is not present at a position corresponding to the heating element 301 and the heating element 30N, the heating element selecting unit 320 selects, as a heating element to be used, a heating element other than the heating element 301 and the heating element 30N.

Next, the heating element selecting unit 320 determines whether the heating element 30N which is positioned at an end portion of the recording material is used (step S903). For example, images may be concentrated at a center portion of the recording material, so that images at the end portion of the recording material are absent. In this case, it is not necessary to turn on the heating element 30N which is positioned at the end portion of the recording material. In the present embodiment, it may be predetermined, by setting, as to whether the heating element 30N which is positioned at the end portion of the recording material is used.

For example, for the setting of using the heating element 30N which is positioned at the end portion of the recording material, the heating element selecting unit 320 selects all heating elements 30N selected in step S902. Moreover, for the setting of not using the heating element 30N which is positioned at the end portion of the recording material, the heating element selecting unit 320 does not select the applicable heating element 30N.

Next, the heating element selecting unit 320 obtains heating element information 22 (see FIG. 3) from the ROM 222. The heating element information 22 according to the present embodiment, which is information on the heating element 200, more specifically includes a temperature decrease rate due to rotating of a fixing belt 138, a temperature increase rate, arrangement and a width of the respective multiple heating elements 320N.

Next, the heating element selecting unit 320 allocates an area of image data to the heating element 30N selected as what is to be used in steps S902 and 5903 with reference to the heating element information 22 of the heating element 30N (step S905). In the present embodiment, when the area is allocated to the heating element 30N, a width and arrangement of the heating element 30N mainly included in the heating element information 22 are referred to.

Figure 10:
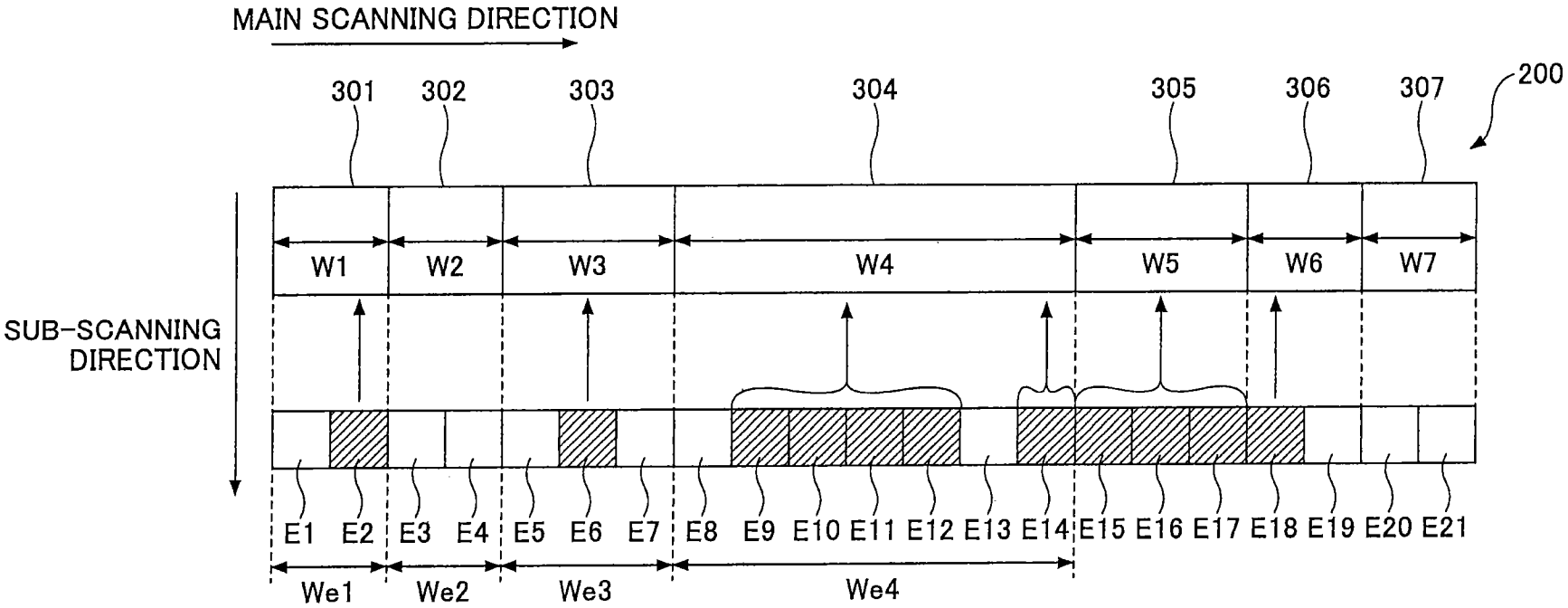
FIG. 10 is a diagram for explaining allocation of an area of image data to a heating element.

Below, with reference to FIG. 10, allocation of the area of the image data to the heating element 30N is described with reference to FIG. 10. FIG. 10 is a diagram which explains allocation of the areas of the image data to the heating element.

FIG. 10 shows an example in which, in the heating element 200, the heating elements 301 to 307 are selected as heating elements to be used. Moreover, an example is shown in which areas E1 to E21 are allocated to the heating element 200.

The heating element selecting unit 320 according to the present embodiment determines, from an address of a register in which a count value of the area E1 is stored, an area of which position in the main scanning and sub-scanning directions the area E1 is in the image data. Then, the heating element selecting unit 320 determines which heating element 30N is caused to heat the area E1 from the position of the area E1.

For example, the heating element located at a position corresponding to the area E1 is the heating element 301. Therefore, the heating element selecting unit 320 allocates the area E1 to the heating element 301. Next, the heating element selecting unit 320 determines whether a total width We1 of the areas E1 and E2 amounts to less than or equal to a width W1 of the heating element 301. Then, if the total width We1<=the width W1, the heating element selecting unit 320 also allocates the area E2 to the heating element 301.

As described above, the heating element selecting unit 320 allocates an area to individual heating elements 30N based on a width in a main scanning direction of the area and the width WN of the heating element 30N.

For example, a width We2 in the main scanning direction of areas E3 and E4 are less than or equal to a width W2 of the heating element 302. Therefore, the heating element selecting unit 320 according to the present embodiment allocates the areas E3 and E4 to the heating element 302. Similarly, the heating element selecting unit 320 allocates areas E5 to E7 to the heating element 303 and areas E8 to E14 to the heating element 304. Moreover, the heating element selecting unit 320 allocates areas E15 to E17 to the heating element 305, areas E18 and E19 to the heating element 306, and areas E20 and E21 to the heating element 307.

As described above, the heating element selecting unit 320 according to the present embodiment allocates, to the heating element 30N, all areas included in the image data. Next, the heating element selecting unit 320 determines whether turning on/off of all the heating elements 30N have been determined (step S906). "Turning on the heating element 30N" here means that the heating element 30N heated to the paper temperature H2 is further heated to the fixing temperature H3. Moreover, "turning off the heating element 30N" means maintaining the heating element 30N at the paper temperature H2 without heating it to the fixing temperature H3.

If turning on/off of the heating element 30N is not yet determined, the fixing control unit 350 proceeds to the next step S907. The heating element selecting unit 320 determines whether an image region is present in an area allocated to the heating element 30N (step S907).

In step S907, if the image region is included in the area allocated, the heating body selecting unit 320 selects the heating element 30N as a heating element to be turned on (step S908) and returns to step S906. Moreover, if the image region is not included in the area allocated in step S907, the heating element selecting unit 320 sets the heating element 30N as a heating element, leaving it off (step S909) and returns to step S906.

In step S906, when on/off of all the heating elements 30N has been determined, it proceeds to a process of step S809 in FIG. 8.

Below, with reference to FIG. 10, determining on/off of the heating element 30N is described. In FIG. 10, areas allocated to the heating element 301 are areas E1 and E2. In an example in FIG. 10, no images are present in the area E1, so that the count value is 0. Therefore, the area E1 is a non-image region. Moreover, the area E2 includes images and the count value is 1. Therefore, the area E2 is an image region. Therefore, in an example in FIG. 10, it is seen that, in an area allocated to the heating element 301, an area in which the count value is not 0, or, in other words, an image region is included. Therefore, in the present embodiment, the heating element 301 is turned on.

Similarly, areas allocated to the heating element 302 are the areas E3 and E4. The count values of the areas E3 and E4 are respectively 0. In other words, in the area allocated to the heating element 302, no image region is present. Therefore, the heating element selecting unit 320 according to the present embodiment turns off the heating element 302.

Similarly, in the example in FIG. 10, heating elements 303, 304, 305, and 306 are turned on, while the heating element 307 is turned off.

As described above, in the present embodiment, only the heating element 30N to which is allocated the image region in which the image is present is heated to the temperature H3. Therefore, according to the present embodiment, toner may be fixed efficiently. Moreover, in the present embodiment, image data read in are considered a set for a predetermined area, and fixing control is performed based on the count value of a pixel for each area, making it possible to reduce an amount of data handled at the time of fixing control.

While all areas are first allocated to the heating element 30N first and then presence/absence of the images are determined in the areas in FIG. 9, it is not limited thereto. For example, presence/absence of images in each area may be determined first, allocating only areas in which an image is present.

While widths of the respective heating elements 30N are described as being different in FIG. 10, it is not limited thereto. For example, the heating elements 30N may all be of the same size or a width of an area may be the same as a width of the heating element 30N.

Figure 11A:
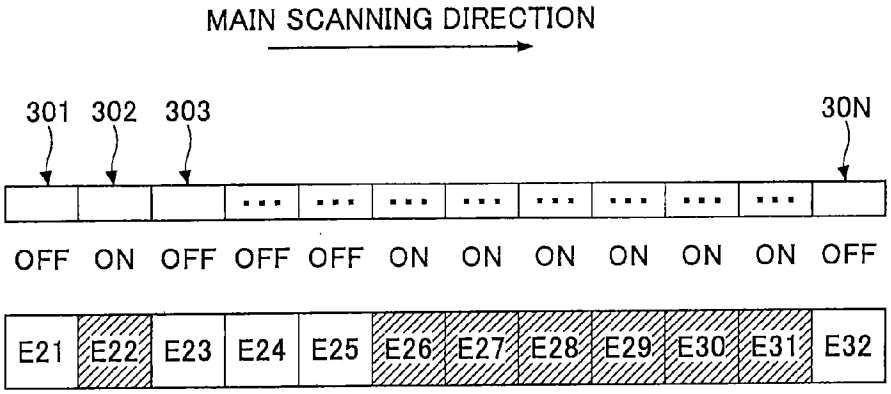
FIGS. 11A and 11B are diagrams showing an example of allocation of the area to the heating element when a width of the area is the same as a width of the heating element.
Figure 11B:
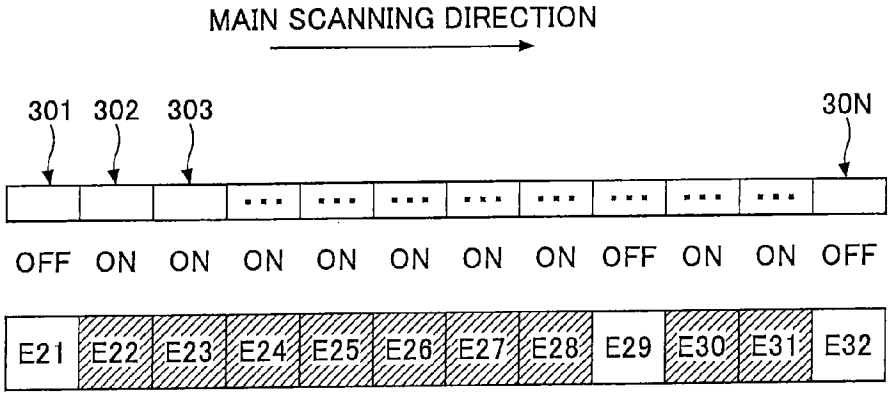

FIGS. 11A and 11B are diagrams showing examples of allocation of an area to the heating element when a width of the area is the same as a width of the heating element. FIG. 11A is a first example of allocation and FIG. 11B is a second example of allocation.

In FIGS. 11A and 11B, areas E21-E32 are allocated to the heating elements 301-30N. In examples in FIGS. 11A and 11B, one area is allocated to one heating element.

In the example in FIG. 11A, of the areas E21-E32, areas which are image regions are the areas E22, and E26-E31. Therefore, the heating elements 30N to which the areas E22 and E26-E31 are allocated are turned on.

In the example in FIG. 11B, of the areas E21-E32, areas which are image regions are the areas E22-E28, E30, and E31. Therefore, the heating elements 30N to which the areas E22-E28, E30, and E31 are allocated are turned on.

As described above, in the present embodiment, image data are considered as a set of predetermined areas and each area is allocated to the multiple heating elements 30N. Then, in the present embodiment, only the heating elements 30N to which an image region is included in the area allocated is heated to the fixing temperature H3, fixing unfixed toner.

Moreover, in the present embodiment, image data are divided into predetermined areas, so that data handled in fixing control becomes a count value for each area. Therefore, in the present embodiment, relative to a case in which written control data based on image data are used in fixing control as they are, an amount of data handled at the time of fixing control may be reduced significantly. Moreover, in the present embodiment, only heating elements 30N to which an area of an image region is allocated are heated to a fixing temperature. Therefore, the present embodiment makes it possible to reduce power related to fixing and to therefore fix toner efficiently.

Moreover, the image data is grasped as a set of predetermined areas, so that each area is allocated to the heating element. Therefore, in the present embodiment, an area may be allocated to a heating element if the heating element information 22 is stored in the ROM 222 even when a shape or the number of heating elements changes. Therefore, the present embodiment may be applied regardless of a shape or configuration of the heating body, making it possible to enhance generality.

While explanations of the present invention may be provided based on respective embodiments, the present invention is not so limited to requirements shown for the above described embodiments. These matters may be changed without compromising the spirit of the present invention, so that they may be appropriately determined according to the applicable embodiments thereof.

The invention claimed is:

1. A fixing control apparatus which controls a fixing apparatus which includes multiple heating elements to fix an unfixed toner image formed based on image data to a recording material, the fixing control apparatus comprising:

a processor configured to:

determine a presence/absence of an image for each of multiple areas into which the image data are divided;

obtain an accumulated value of a pixel count value for each of the areas;

determine that the image is present in the area when the accumulated value is at least a predetermined value;

select a heating element located at a position corresponding to an area in which the image is present from the multiple heating elements; and cause the heating element selected to be heated.

2. The fixing control apparatus as claimed in claim 1, further comprising:

a memory which stores therein heating element information including information related to a width of the heating element and an arrangement of the heating element, wherein the processor is configured to select the heating element based on the heating element information.

3. The fixing control apparatus as claimed in claim 1, further comprising:

a register corresponding to the area in which the accumulated value is stored, wherein the processor is configured to determine a position of the area in the image data based on an address of the register and to select a heating element located at a position corresponding to the area based on a width of the heating elements and an arrangement of the heating elements that are included in heating element information.

4. A non-transitory computer readable medium having a fixing control computer program recorded thereon, the fixing control computer program configured to perform a method when executed by a fixing control apparatus which controls a fixing apparatus which includes multiple heating elements to fix an unfixed toner image formed based on image data to a recording material, the method comprising:

determining a presence/absence of an image for each of multiple areas into which the image data are divided;

obtaining an accumulated value of a pixel count value for each of the areas;

determining that the image is present in the area when the accumulated value is at least a predetermined value;

selecting a heating element located at a position corresponding to an area in which the image is present from the multiple heating elements; and causing the heating element selected to be heated.

5. An image forming apparatus, comprising:

a fixing control apparatus which controls a fixing apparatus which includes multiple heating elements to fix an unfixed toner image formed based on image data to a recording material, the fixing control apparatus including a processor that is configured to:

determine a presence/absence of an image for each of multiple areas into which the image data are divided;

obtain an accumulated value of a pixel count value for each of the areas;

determine that the image is present in the area when the accumulated value is at least a predetermined value;

select a heating element located at a position corresponding to an area in which the image is present from the multiple heating elements; and cause the heating element selected to be heated.

* * * * *